US012797932B2

(12) United States Patent
Yamaguchi

(10) Patent No.: US 12,797,932 B2
(45) **Date of Patent: *Nov. 17, 2026**

(54) METAL SHEET BENT PORTION FATIGUE CRACK GROWTH SUPPRESSING METHOD AND AUTOMOTIVE PART

(71) Applicant: JFE STEEL CORPORATION, Tokyo (JP)

(72) Inventor: Naoki Yamaguchi, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 248 days.

This patent is subject to a terminal disclaimer.

(21) Appl. No.: 18/700,790

(22) PCT Filed: Jul. 22, 2022

(86) PCT No.: PCT/JP2022/028479

§ 371 (c)(1),
(2) Date: Apr. 12, 2024

(87) PCT Pub. No.: WO2023/079800

PCT Pub. Date: May 11, 2023

(65) Prior Publication Data

US 2024/0416405 A1 Dec. 19, 2024

(30) Foreign Application Priority Data

Nov. 8, 2021 (JP) ..... 2021-181585

(51) Int. Cl.

| | |
|---|---|
| ***B21D 31/06*** | (2006.01) |
| ***B21D 1/06*** | (2006.01) |
| ***B21D 5/00*** | (2006.01) |

(52) U.S. Cl.
CPC *B21D 5/00* (2013.01); *B21D 1/06* (2013.01)

(58) Field of Classification Search
CPC .... C21D 7/06; C21D 7/04; B23P 9/04; B21D 31/06

(Continued)

(56) References Cited

U.S. PATENT DOCUMENTS

| | | | |
|---|---|---|---|
| 5,735,163 | A | 4/1998 | Sato et al. |
| 2005/0163858 | A1 | 7/2005 | Boehm et al. |

(Continued)

FOREIGN PATENT DOCUMENTS

| | | | |
|---|---|---|---|
| CN | 110769972 | A | 2/2020 |
| CN | 113104110 | A | 7/2021 |

(Continued)

OTHER PUBLICATIONS

Apr. 25, 2025 extended Search Report issued in European Patent Application No. 22889625.4.

(Continued)

*Primary Examiner* — Debra M Sullivan
(74) *Attorney, Agent, or Firm* — Oliff PLC

(57) ABSTRACT

A metal sheet bent portion fatigue crack growth suppressing method suppresses a growth of a fatigue crack generated in a bent portion formed by bending a metal sheet, and includes applying a plastic strain at least in a range from a bending start point to a bending end point on a bend inner side of the bent portion in a direction orthogonal to a valley line direction of the bent portion at an interval equal to or larger than a sheet thickness of the metal sheet in the valley line direction so as to generate a compressive residual stress.

3 Claims, 4 Drawing Sheets

(58) Field of Classification Search
USPC ..... 72/710
See application file for complete search history.

(56) References Cited

U.S. PATENT DOCUMENTS

| | | | | |
|---|---|---|---|---|
| 2006/0133940 | A1 | 6/2006 | Broderick et al. | |
| 2008/0069878 | A1 | 3/2008 | Venkatesh et al. | |
| 2008/0223099 | A1 | 9/2008 | David | |
| 2010/0135780 | A1 | 6/2010 | David | |
| 2011/0123820 | A1 | 5/2011 | Shimanuki et al. | |
| 2014/0007394 | A1* | 1/2014 | Haas | C21D 7/04 29/90.01 |
| 2016/0158914 | A1* | 6/2016 | Egawa | C21D 7/06 72/53 |
| 2021/0146488 | A1 | 5/2021 | Reeb et al. | |
| 2022/0177988 | A1 | 6/2022 | Shiozaki et al. | |

FOREIGN PATENT DOCUMENTS

| | | | |
|---|---|---|---|
| CN | 113543927 | A | 10/2021 |
| GB | 2561564 | A | 10/2018 |
| JP | S58-11284 | B2 | 3/1983 |
| JP | H01-259118 | A | 10/1989 |
| JP | H04-182033 | A | 6/1992 |
| JP | H07-155841 | A | 6/1995 |
| JP | H08-117879 | A | 5/1996 |
| JP | 2000-225567 | A | 8/2000 |
| JP | 2004-169065 | A | 6/2004 |
| JP | 2010-029897 | A | 2/2010 |
| JP | 4441641 | B1 | 3/2010 |
| JP | 2016-205024 | A | 12/2016 |
| JP | 2018-051608 | A | 4/2018 |
| JP | 2018-051609 | A | 4/2018 |
| JP | 2019-178382 | A | 10/2019 |
| JP | 2020-142291 | A | 9/2020 |
| WO | 2010/096820 | A1 | 8/2010 |
| WO | 2018/051292 | A1 | 3/2018 |

OTHER PUBLICATIONS

Aug. 30, 2022 International Search Report issued in International Patent Application No. PCT/JP2022/028479.

Aug. 3, 2022 Office Action issued in U.S. Appl. No. 17/716,790.

Jan. 11, 2023 Notice of Allowance issued in U.S. Appl. No. 17/716,790.

Apr. 7, 2026 Office Action issued in Chinese Patent Application No. 202280073210.6 with the Search Report in English.

Feb. 27, 2026 Office Action issued in U.S. Appl. No. 18/716,790.

* cited by examiner (a) SCHEMATIC DIAGRAM OF CRACK (b) STRESS INTENSITY FACTOR (c) CORRESPONDENCE BETWEEN STRESS INTENSITY FACTOR (K(0)) AND CRACK

METAL SHEET BENT PORTION FATIGUE CRACK GROWTH SUPPRESSING METHOD AND AUTOMOTIVE PART

FIELD

The present invention relates to a fatigue crack growth suppressing method, which is a method of suppressing a growth of a fatigue crack in a bent portion of a metal sheet, being a portion formed by bending the metal sheet, and an automotive part having a bent portion formed by bending the metal sheet, provided as a part configured to suppress the growth of a fatigue crack in the bent portion.

BACKGROUND

It is known that, in a bent portion of a metal sheet, formed by press forming on the metal sheet, a crack is generated on a surface on a bend inner side because a locally strong compressive stress is applied, and that application of cyclic load to a part having such a bent portion causes a growth of the crack, leading to deterioration of a fatigue life. To handle this, there have been proposed some techniques of improving the fatigue life of a part having a bent portion formed by bending a metal sheet.

In order to suppress generation of a crack on an inner surface of a local portion constituting a root of a burring portion during coining of a metal sheet, Patent Literature 1 and Patent Literature 2 disclose a technique of suppressing generation of a crack on an inner surface of a curved portion by performing bending with a radius of curvature (including an infinite radius of curvature, that is, a straight line) different from a final shape in a first step and performing bending with a radius of curvature of the final shape in a second step to introduce a tensile stress to the inner surface of the bending. In addition, Patent Literature 3 proposes a technique of subjecting a surface of a metal sheet to which bending stress is applied to surface hardening treatment by shot peening, thereby enhancing yield stress and improving fatigue strength after the shot peening. Furthermore, as a method of repairing a fatigue crack generated in a curved sheet portion of a steel material, Patent Literature 4 discloses a technique in which an opening portion of a fatigue crack is closed by peening at least one side of both sides sandwiching the fatigue crack on a surface of the steel material in parallel with the fatigue crack, and then the portion immediately above the fatigue crack is further subjected to peening.

CITATION LIST

Patent Literature

Patent Literature 1: JP 2018-51608 A
Patent Literature 2: JP 2018-51609 A
Patent Literature 3: JP 2000-225567 A
Patent Literature 4: JP 4441641 B

SUMMARY

Technical Problem

The technique disclosed in Patent Literature 1 has a problem that it is necessary to prepare two types of molds because the step of performing the bending includes two steps, increasing the manufacturing cost. The technique disclosed in Patent Literature 2 has a problem that applicable portions are limited to the burring portion. The technique disclosed in Patent Literature 3 uses shot peening, making it necessary to perform processing in a sealed container in order to prevent scattering of a projection material. The technique disclosed in Patent Literature 4 is a method of peening a flat sheet or a weld toe using an air-type hammer peening device. The technique, however, has a problem when being applied to a part having a bent portion formed by bending a metal sheet, that productivity is low because the whole of a bend inner side of the bent portion, which is a risk portion of crack generation, receives impact, an impact load of an impact pin used for peening could deform the entire part, and a bending angle of the bent portion would be expanded when a tip radius of the impact pin is larger than a radius of curvature of the bent portion.

The present invention has been made to solve the problems as described above, and aims to provide a metal sheet bent portion fatigue crack growth suppressing method, which is capable of suppressing the growth of a fatigue crack of a bent portion, applicable to the bent portion after being bent without increasing the manufacturing cost of the bending of the metal sheet, without deteriorating the productivity and without changing the bending angle of the entire part or the bent portion, and provide an automotive part including a bent portion formed by bending a metal sheet, and capable of suppressing the growth of the fatigue crack in the bent portion.

Solution to Problem

A metal sheet bent portion fatigue crack growth suppressing method according to the present invention suppresses a growth of a fatigue crack generated in a bent portion formed by bending a metal sheet and includes applying a plastic strain at least in a range from a bending start point to a bending end point on a bend inner side of the bent portion in a direction orthogonal to a valley line direction of the bent portion at an interval equal to or larger than a sheet thickness of the metal sheet in the valley line direction so as to generate a compressive residual stress.

Moreover, the compressive residual stress is generated by forming an indentation band, which is a series of indentations, on the bend inner side of the bent portion by a needle peening treatment using an impact pin, and as the impact pin, an impact pin that has a radius of curvature of a tip thereof, in a cross section orthogonal to the valley line direction, equal to or less than a radius of curvature of the bent portion is used.

Moreover, an automotive part according to the present invention includes a bent portion formed by bending a metal sheet, wherein a growth of a fatigue crack is suppressed in the bent portion; and an indentation band which is a series of indentations formed by a needle peening treatment using an impact pin, the indentation band being formed at least in a range from a bending start point to a bending end point on a bend inner side of the bent portion in a direction orthogonal to a valley line direction of the bent portion at an interval equal to or larger than a sheet thickness of the metal sheet in the valley line direction.

Advantageous Effects of Invention

In the present invention, it is possible to suppress the growth, in the valley line direction, of the crack generated on the bend inner side of the bent portion formed by bending the metal sheet, and it is possible to effectively improve the fatigue life of the automotive part having the bent portion.

DESCRIPTION OF EMBODIMENTS

Background of the Present Invention

Figure 2:
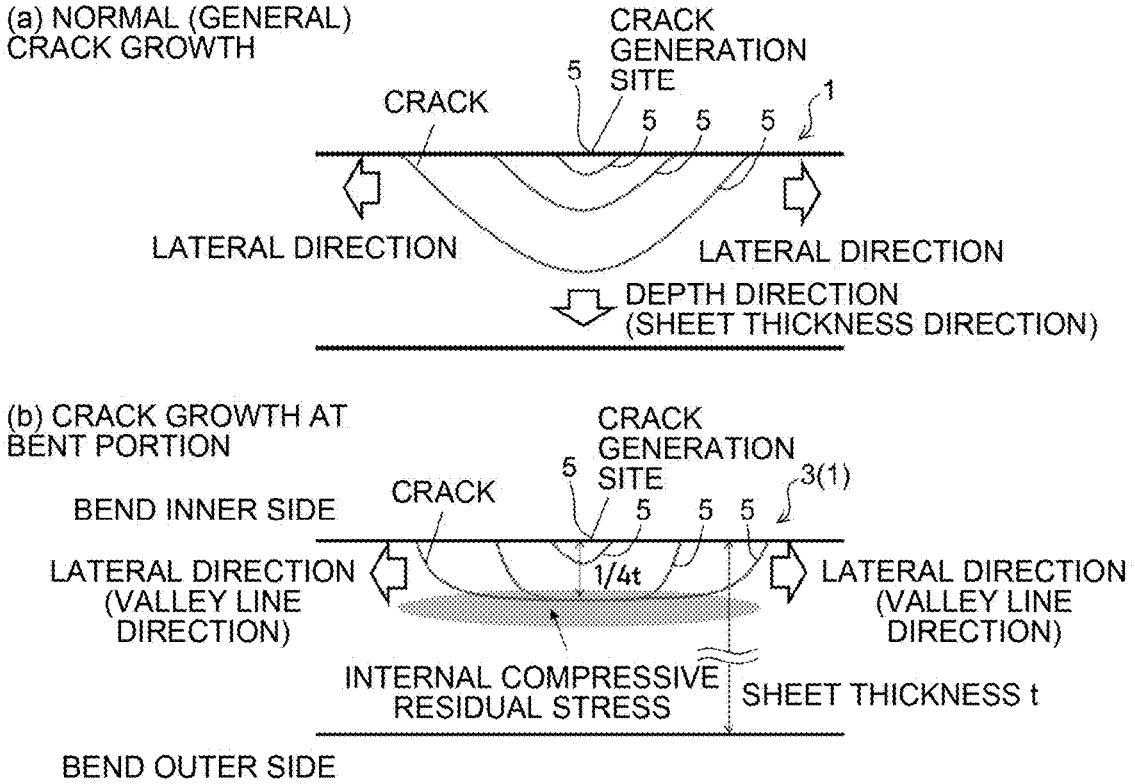
FIG. 2 is a diagram illustrating a growth of a fatigue crack in a bent portion and a concept for suppressing the growth of the fatigue crack as a background leading to the present invention (specifically, (a) illustrates a crack growth in a normal (general) metal sheet, and (b) illustrates a crack growth in the bent portion).

As illustrated in FIG. 2(*a*), a fatigue crack generated on a surface of a metal sheet typically grows with expansion of a semi-elliptical crack surface in both a lateral direction (direction along the surface of a metal sheet 1) and a depth direction (sheet thickness direction of the metal sheet 1) from a generation position of a crack 5, and eventually, the crack surface reaches the back surface of the metal sheet 1, leading to fatigue fracture.

In view of this, as illustrated in FIG. 2(*b*), the inventors perform close observation of a growth process of a fatigue crack generated on a bend inner side of a bent portion 3 formed by bending the metal sheet 1. As a result, it has been found that the crack 5 generated on the bend inner side of the bent portion 3 grows in both the depth direction (the sheet thickness direction of the metal sheet 1) and the lateral direction (a valley line direction on the bend inner side) in the bent portion 3 immediately after generation, but the growth of the crack 5 in the sheet thickness direction stops at about ¼ of a sheet thickness t as illustrated in FIG. 2(*b*) and thereafter the crack 5 grows only in the lateral direction.

Figure 3:
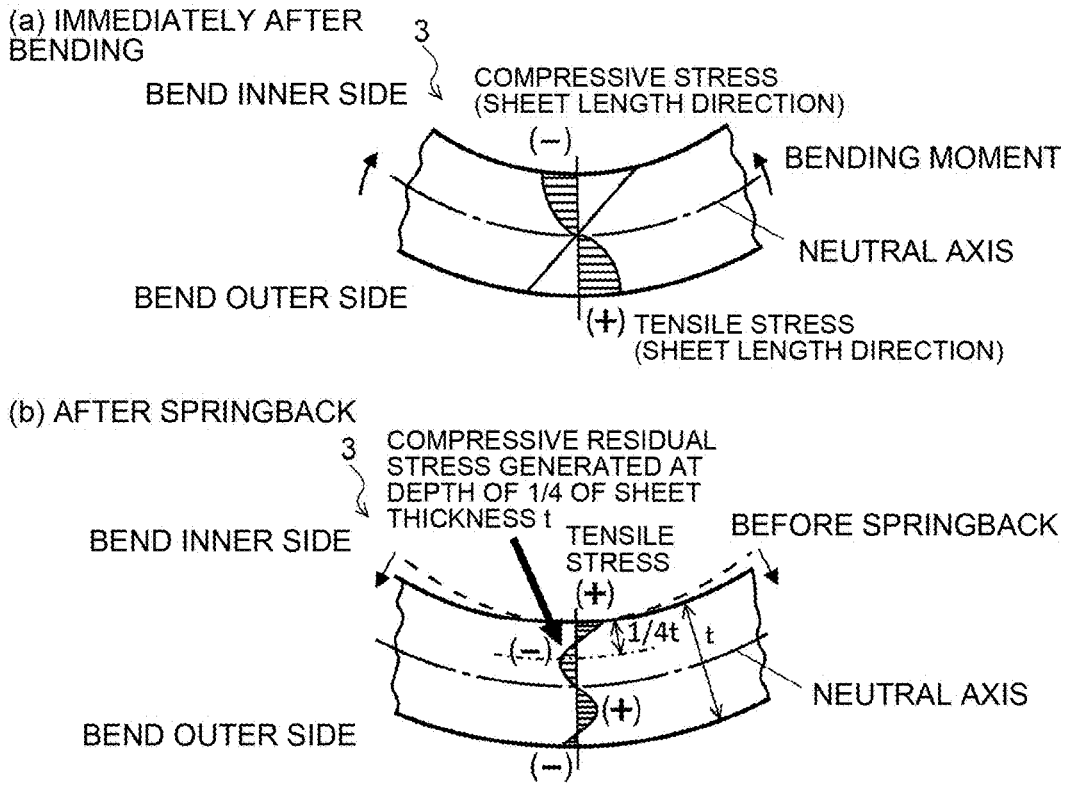
FIG. 3 is a diagram illustrating stress distribution in a bent portion as the background of the present invention (specifically, (a) is a state immediately after bending, (b) is a state after springback).

In examination of the cause of this, the inventors focused on stress distribution in the bent portion 3 as illustrated in FIG. 3. As illustrated in FIG. 3(*a*), immediately after the metal sheet 1 is bent, the bent portion 3 is subjected to compressive stress in a region on the bend inner side of the neutral axis and subjected to tensile stress in a region on a bend outer side of the neutral axis. However, after the bending moment of the bent portion 3 is unloaded to cause springback, as illustrated in FIG. 3(*b*), the stress on a surface layer portion on the bend inner side is reversed to the tensile stress, and the compressive stress remains at a position of about ¼ of the sheet thickness t from the surface on the bend inner side of the bent portion 3.

From this observation, it has been found that the reason why the growth of the fatigue crack generated on the bend inner side of the bent portion 3 in the depth direction (sheet thickness direction) stops at a depth of about ¼ of the sheet thickness from the surface of the bend inner side is due to the compressive residual stress remaining inside the bent portion 3 even after the springback.

Therefore, based on the above finding that the growth of the crack in the sheet thickness direction stops due to the compressive residual stress remaining inside the bent portion, the inventors conceived that it is possible to prevent or suppress the growth of the crack in the valley line direction (lateral direction) of the crack 5 in the bent portion 3 by applying plastic strain at predetermined intervals in the valley line direction (lateral direction) to generate the compressive residual stress.

The present invention has been made through various examinations based on the above concept, and specifically has the following configuration.

First Embodiment

<Metal Sheet Bent Portion Fatigue Crack Growth Suppressing Method>

A metal sheet bent portion fatigue crack growth suppressing method according to the first embodiment of the present invention is a method of suppressing the growth of a fatigue crack generated in a bent portion 3 formed by bending a metal sheet 1. Specifically, the method includes, as illustrated in FIG. 1, applying a plastic strain at least in a range from a bending start point 3*a* to a bending end point 3*b* on a bend inner side of the bent portion 3 in a direction orthogonal to a valley line direction on the bend inner side of the bent portion 3 at an interval of a sheet thickness t or more of the metal sheet 1 in the valley line direction, thereby generating a compressive residual stress.

Figure 1:
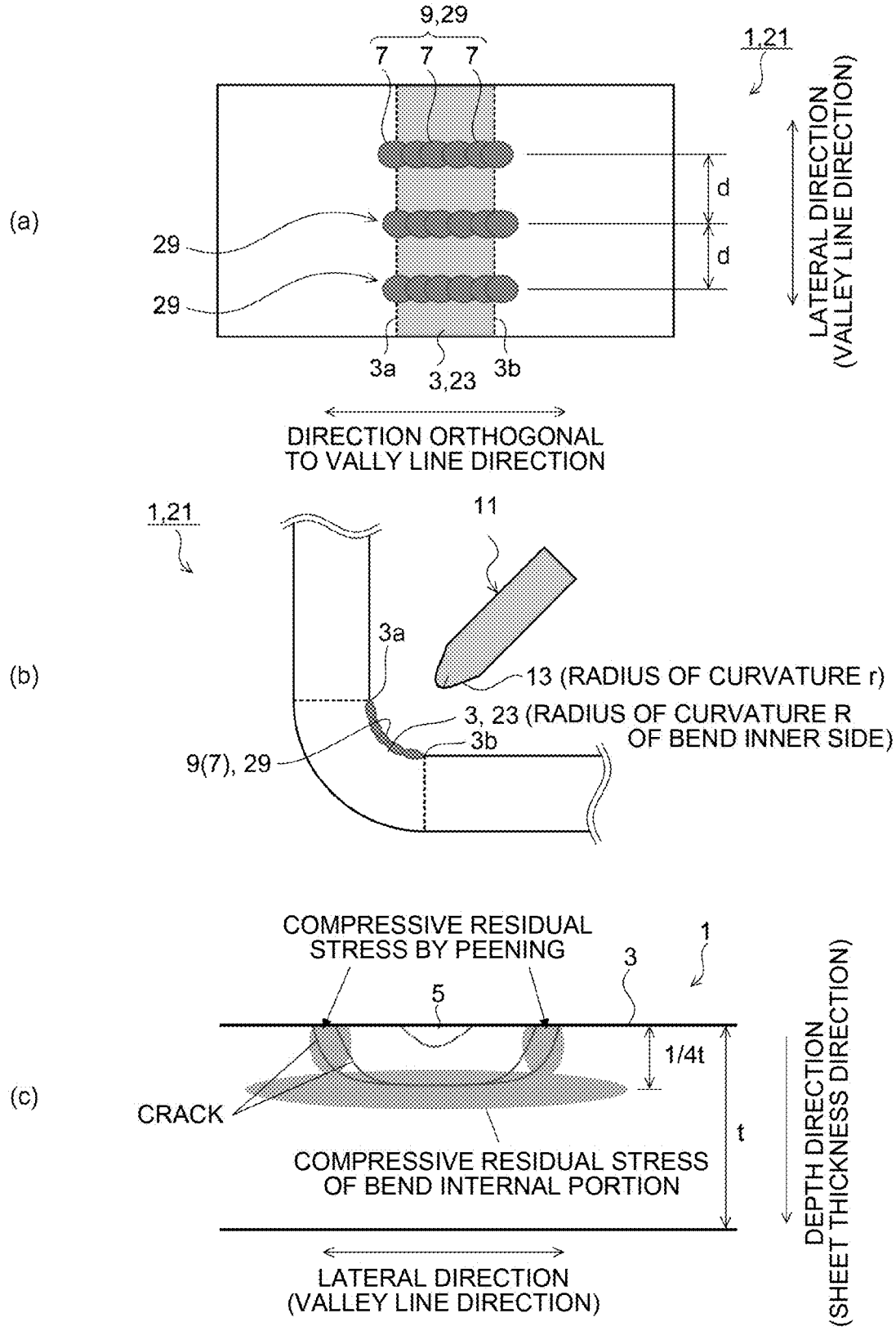
FIG. 1 is a diagram illustrating a metal sheet bent portion fatigue crack growth suppressing method according to a first embodiment of the present invention and an automotive part according to a second embodiment of the present invention (specifically, (a) is a plan view in a direction facing the bent portion, (b) is a cross-sectional view, and (c) is an explanatory view of a crack surface and a compressive residual stress generated inside the bent portion).

In addition, in the present first embodiment, as illustrated in FIG. 1(*b*), the compressive residual stress is generated by forming an indentation band 9 (refer to FIG. 1(*a*)) which is a series of indentations 7 within a range from the bending start point 3*a* to the bending end point 3*b* on the bend inner side of the bent portion 3 by needle peening treatment using an impact pin 11. At this time, an interval d in the valley line direction of the indentation band 9 is equal to or greater than a sheet thickness t of the metal sheet 1. A radius of curvature r of a tip 13 of the impact pin 11, in the cross section orthogonal to the valley line direction, is equal to or less than a radius of curvature R on the bend inner side of the bent portion 3.

The reason why the metal sheet bent portion fatigue crack growth suppressing method according to the present first embodiment suppresses the growth of a crack generated on the bend inner side of the bent portion 3 in the valley line direction will be described based on the results of examination on a stress intensity factor at the tip of a crack generated on the bend inner side of the bent portion 3 of the metal sheet 1 illustrated in FIG. 4.

Figure 4:
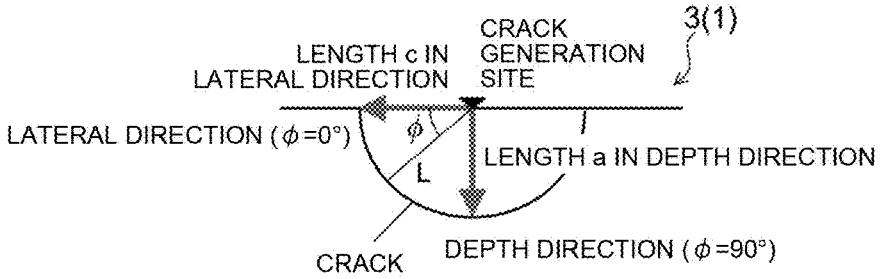
FIG. 4 is a diagram illustrating a result of examining a stress intensity factor in a bent portion as the background of the present invention (specifically, (a) is a schematic diagram of a crack surface, (b) is a diagram illustrating a stress intensity factor in a depth direction and a lateral direction in the crack surface, and (c) is a diagram illustrating a correspondence between a stress intensity factor K(0) in the lateral direction at a crack tip and the crack surface).
Figure 4:
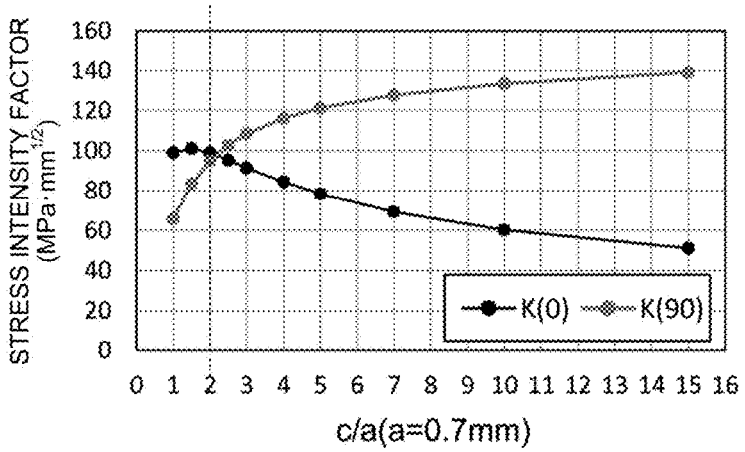
Figure 4:
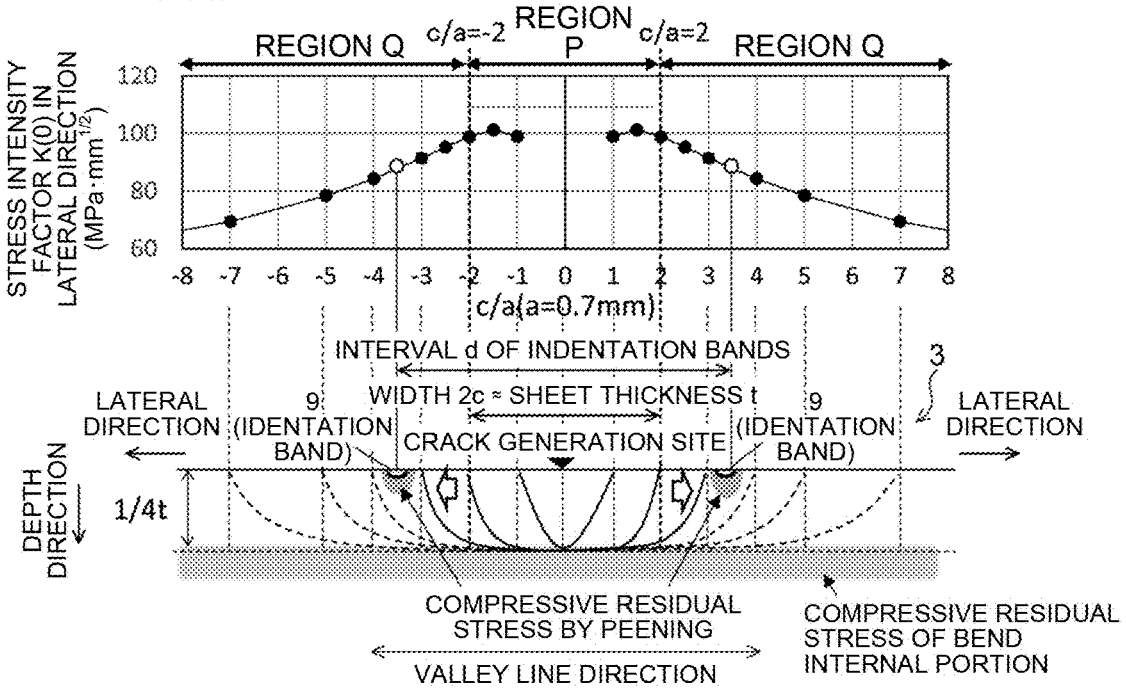

FIG. 4(*a*) is a diagram schematically illustrating a shape of a crack surface. It is assumed that the crack generated on the surface on the bend inner side of the bent portion 3 of the metal sheet 1 grows with its crack surface expanding in a semi-elliptical shape in both the depth direction and the lateral direction as illustrated in FIG. 4(*a*).

FIG. 4(*b*) illustrates a result of calculating a stress intensity factor K at the tip of the crack growing in each of the lateral direction (valley line direction on the bend inner side) and the depth direction (sheet thickness direction) using a Newman-Raju's Formula (known literature: J. C. Newman Jr. and I. S. Raju: Eng. Fract. Mech., Vol. 15, No. 1-2 (1981), p. 185) in the following.

$$K = (\sigma_t + H(a, c, t, \phi)\sigma_b)\sqrt{\frac{\pi a}{Q(a, c)}} \cdot F(a, c, b, t, \phi)$$

In the above Formula, σt is a tensile stress; ob is a bending stress; a is a length of a crack surface in a depth direction (sheet thickness direction); c is a length of the crack surface in a lateral direction (distance from a crack generation site to a crack tip in the lateral direction); b is a width of the metal sheet 1; t is a sheet thickness of the bent portion 3 (on the metal sheet 1); q is an angle formed by a straight line L, being a line connecting the crack generation site and the crack tip, and the surface of the bent portion 3; and H(a,c, t,φ), Q(a,c), and F(a,c,b,t,φ) are functions given by individual variables (refer to the above known Literatures).

In FIG. 4(*b*), K(0) is a stress intensity factor that grows in the lateral direction (valley line direction on the bend inner side), that is, in a direction of φ=0°; K(90) is a stress intensity factor that grows in the depth direction (sheet thickness direction), that is, in a direction of φ=90°. The calculation of K(0) and K(90) uses the settings: the sheet thickness t (=2.8 mm); the sheet width 50 mm; and the bending load 100 MPa, and a depth a of the crack is set to 0.7 mm, which is ¼ of the sheet thickness t of 2.8 mm. FIG. 4(*b*) illustrates a relationship between a crack surface ratio c/a, which is an index representing the shape of the semi-elliptical crack surface, and K(0) and K(90). Note that the above Formula does not consider the influence of the compressive residual stress at a depth of about ¼ of the sheet thickness t from the surface on the bend inner side.

From the graph illustrated in FIG. 4(*b*), it can be seen that the stress intensity factor K(0) in the lateral direction has a substantially constant high value in the region where the crack surface ratio c/a is in a range |c/a|≤2 (hereinafter, the region is referred to as a "region P"), that is, when the shape of the crack surface is nearly semicircular, and this indicates a great driving force of the propagation (growth) of the crack in the lateral direction. In contrast, in the region where the crack surface ratio |c/a|>2 (hereinafter, the region is referred to as a "region Q"), it can be seen that the more the shape of the crack surface approaches a semi-elliptical shape expanding in the lateral direction (the larger the absolute value of c/a), the lower the stress intensity factor K(0) becomes, and the smaller the driving force of propagation of the crack in the lateral direction. In short, the magnitude of the driving force for propagation of a crack in the lateral direction changes beyond the turning point of the crack surface ratio |c/a|=2.

Here, based on the above examination result, a concept of suppressing the growth of the crack generated on the bend inner side of the bent portion 3 in the valley line direction (lateral direction) will be described. Assuming that the growth of the crack in the depth direction stops at a position of about ¼ of the sheet thickness t, a length a of the crack surface in the depth direction is expressed as a ≈t/4. Accordingly, when the crack surface ratio c/a=2, a relationship of 2c≈t is established. On assumption that the crack grows symmetrically in the lateral direction, 2c is a width of the crack surface in the lateral direction. Accordingly, it can be seen that the width (=2c) of the crack surface in the lateral direction when the crack surface ratio c/a=2 is substantially the same as the sheet thickness t of the metal sheet 1.

That is, when the purpose is to prevent or suppress fatigue fracture due to growth in the valley line direction (lateral direction) of a crack generated on the bend inner side of the bent portion 3, while the growth of the crack in the depth direction stops at the position of ¼ of the sheet thickness t and the width (=2c) of the crack surface in the lateral direction is equal to or less than the sheet thickness t in the process in which the crack further grows only in the lateral direction, it is considered that the stress intensity factor K(0) in the lateral direction is larger than the stress intensity factor K(90) in the depth direction and that the driving force of the crack propagation in the lateral direction is large. Therefore, stopping the crack propagation in the region is considered to be difficult.

However, in the region (region Q) where the crack grows to some extent and the width (=2c) of the crack surface in the lateral direction spreads to the sheet thickness t or more, the stress intensity factor K(0) is smaller than the stress intensity factor K(90) in the depth direction, and gradually decreases with an increase in the absolute value of the crack surface ratio c/a. Therefore, it is considered that the driving force of the crack propagation is also small in the region, and the crack propagation is to be stopped easily in this region.

Therefore, by allowing the growth of the crack in the region Q in which the stress intensity factor K(0) in the lateral direction is low, rather than stopping the growth of the crack in the region P in which the stress intensity factor K(0) in the lateral direction is high as compared with the depth direction, it is considered to be able to stop or suppress the crack with a compressive residual stress lower than that in the region P.

FIG. 4(*c*) illustrates a graph indicating a relationship between the stress intensity factor K(0) in the lateral direction at the crack tip and the crack surface ratio c/a, and a diagram schematically illustrating a crack surface when the indentation band 9 is formed in the region Q of the crack by needle peening treatment using the impact pin 11 as illustrated in FIG. 1 and compressive residual stress is applied. In the example illustrated in FIG. 4(*c*), the interval d of the indentation bands 9 illustrated in FIG. 1 is set to be larger than the sheet thickness t (~the width 2c of the crack surface in the lateral direction when the crack surface ratio c/a=2), and the stress intensity factor K(0) at the position where the compressive residual stress is applied by needle peening is 10% to 12% lower than the stress intensity factor K(0) in the region P (−2≤c/a≤2).

In this manner, by forming the indentation band 9 at the interval d, which is the sheet thickness t or more, in the valley line direction of the bent portion 3 and applying the compressive residual stress, it is possible to suppress the growth of the crack in the valley line direction.

In the present first embodiment, the compressive residual stress of the bent portion 3 is generated by forming the indentation band 9, which is a series of the indentations 7, on the bend inner side of the bent portion 3 by the needle peening treatment using the impact pin and applying plastic strain thereto as described above, in which a radius of curvature r of the tip 13 of the impact pin 11, in a cross section orthogonal to the valley line direction, is preferably equal to or less than the radius of curvature R of the bent portion 3.

This is because, in a case where the radius of curvature r of the tip 13 of the impact pin 11 is larger than the radius of curvature R of the bent portion 3, the bent portion 3 cannot be directly impacted by the tip 13 of the impact pin 11, making it difficult to appropriately generate the compressive residual stress in the bent portion 3.

Incidentally, there may be, in a part of the bend inner side of the bent portion 3, an occurrence of buckling deformation during bending, in which the radius of curvature can be locally extremely small. However, the radius of curvature R of the bent portion 3 may be defined as a macroscopic radius of curvature except for a case where the radius of curvature of the bent portion 3 is globally changed by buckling.

Furthermore, regarding the deformation of the bent portion 3 and the surroundings thereof in the metal sheet 1 due to the impact load of the impact pin and regarding the expansion of the bending angle of the bent portion 3 in a case where the radius of curvature of the impact pin 11 is larger than the radius of curvature of the bent portion 3, which are problems in the technique in Patent Literature 4 described above, the present first embodiment has a configuration in which the impact is performed by the impact pin 11 having the radius of curvature r smaller than the radius of curvature on the bend inner side of the bent portion 3, making it possible to suppress the deformation of the metal sheet 1 and the change in the bending angle of the bent portion 3 and possible to appropriately introduce the compressive residual stress to the bent portion 3.

In addition, the range in which the indentation band 9 is to be formed in the direction orthogonal to the valley line direction on the bend inner side of the bent portion 3 may be set to all or a part of the range from the bending start point to the bending end point on the bend inner side. Here, the bending start point and the bending end point refer to bend R stops on the bend inner side of the bent portion 3.

At this time, when the crack generation position is obvious due to cracks and wrinkles in the width direction of the bent portion 3, stress conditions applied to the metal sheet, or the like, there is no need to perform treatment over the entire range of the bent portion 3 in the valley line direction on the bend inner side, and it is only required to generate compressive residual stress by forming the indentation band 9 only in the neighboring portion of the crack generation position and applying plastic strain.

The upper limit of the interval d of the indentation bands 9 in the valley line direction on the bend inner side of the bent portion 3 is not particularly defined, and may be determined based on the lifespan required for a part formed by bending a metal sheet, or the allowable crack length such as a length of crack allowable as a part and the lower limit of the crack length that can be found in periodic inspection.

Note that the present invention may include needle peening treatment performed simultaneously with a plurality of impact pins, and further improvement in productivity can be expected when combined with an automatic implementation method using a robot arm or the like. Furthermore, in the case of a part having a large number of bent portions, such as an automotive part, applying this treatment to the entire region of the bent portion would deteriorate productivity. Therefore, it is preferable, in this case, to limit application only to a location where the radius of curvature of the bent portion is small or a location where fatigue fracture on the bend inner side is likely to occur as a result of a fatigue test, stress analysis, or the like, performed in advance.

Furthermore, the present invention can be sufficiently applied with generation, in the bent portion, of the compressive residual stress capable of suppressing the growth of the crack in the valley line direction of the bent portion. Therefore, the method of generating the compressive residual stress is not limited to needle peening, and similar treatment may be performed by a method such as laser peening, shot peening, or cold spray. In the case of shot peening, masking is performed at a position other than a position where it is desired to introduce an indentation so as not to cause unnecessary plastic deformation, whereby similar effects can be obtained. These methods are methods in which plastic strain is applied to a material to generate compressive residual stress. Specifically, laser peening uses a shock wave during laser irradiation, while shot peening and cold spraying use projection of a projection material to give an impact to a bent portion, thereby applying plastic strain to the bent portion.

When the bending of the metal sheet is performed not as pure bending but with tensile and compression in the axial direction, there will be a shift in the position in the sheet thickness direction into which the compressive residual stress is introduced, but also in this case, the crack will stop at the position where the compressive residual stress is present. Therefore, when the position of the compressive residual stress does not greatly differ from the position ¼ of the sheet thickness t, implementation may be performed under the condition that the relationship between a depth a of the compressive residual stress and a length c of the crack surface in the lateral direction satisfies $2c>4a$.

When the position in the depth direction where the compressive residual stress is introduced greatly deviates from the position ¼ of the sheet thickness due to springback, recalculation may be performed by the above method, and the interval d at which the needle peening treatment is to be performed may be determined based on the value of c/a at which K(0) decreases.

As described above, according to the present invention, the fatigue life of the part having the bent portion formed by bending a metal sheet can be effectively improved. Furthermore, according to the present invention, it is not necessary to perform the peening treatment on the entire surface on the bend inner side of the bent portion. This leads to improvement in productivity and the effect of improving the fatigue life due to the compressive residual stress and work hardening due to the local plastic strain applied on the bend inner side.

Still further, according to the present invention, even with no occurrence of cracks on the bend inner side of the bent portion, it is still possible to have an effect of reducing microscopic stress concentration because there is an effect of smoothing microscopic irregularities such as wrinkles. In addition, by using the impact pin having a tip with a small radius of curvature, it is possible to reduce the impact load required for deforming the metal sheet to form the indentation band. This makes it possible to perform stable implementation by suppressing the reaction force, leading to achievement of not only suppression of macroscopic deformation of the entire part being a possible concern when the method described in Patent Literature 4 is applied to a part having a bent portion of a metal sheet, but also application of the method to a production line using a robot arm or the like.

In addition, the present invention makes it possible to eliminate the possibility of insufficient performance of impact due to insufficient contact of the impact pin with the surface on the bend inner side of the bent portion. Furthermore, in application of the present invention to the manufacture of an automotive part, there is no need to use an additional press mold for performing bending work, unlike the method described in Patent Literature 1, application is possible to a burring portion as in the method described in Patent Literature 2, and furthermore, there is no need to use a scattering preventing container required for a shot peening treatment as in the method described in Patent Literature 3.

Second Embodiment

<Automotive Part>

As illustrated in FIG. 1, an automotive part according to the second embodiment of the present invention has a bent portion 3 formed by bending a metal sheet 1. The automotive part is configured to suppress growth of a fatigue crack in the bent portion, and has an indentation band which is a series of indentations formed by a needle peening treatment using an impact pin, the indentation band formed at least in a range from a bending start point to a bending end point on the bend inner side of the bent portion 3 in a direction orthogonal to a valley line direction of the bent portion 3 at an interval equal to or larger than a sheet thickness of the metal sheet in the valley line direction.

Also in the automotive part according to the present second embodiment, similarly to the metal sheet bent portion fatigue crack growth suppressing method according to the first embodiment of the present invention described above, it is possible to suppress the growth of the crack in the valley line direction on the bend inner side of the bent portion by the compressive residual stress generated by the indentation band by the needle peening treatment at an interval equal to or larger than the sheet thickness of the metal sheet in the valley line direction, improving the fatigue life.

Although the plastic strain applied to the bent portion is obtained by the needle peening treatment in the automotive part according to the present second embodiment, the plastic strain to be applied to the bent portion in the automotive part according to the present invention is not limited to the plastic strain obtained by the needle peening treatment, and may be the plastic strain obtained by a treatment such as laser peening, shot peening, or cold spraying.

Example

An experiment performed for confirming operational effects of the present invention will be described below.

Figure 5:
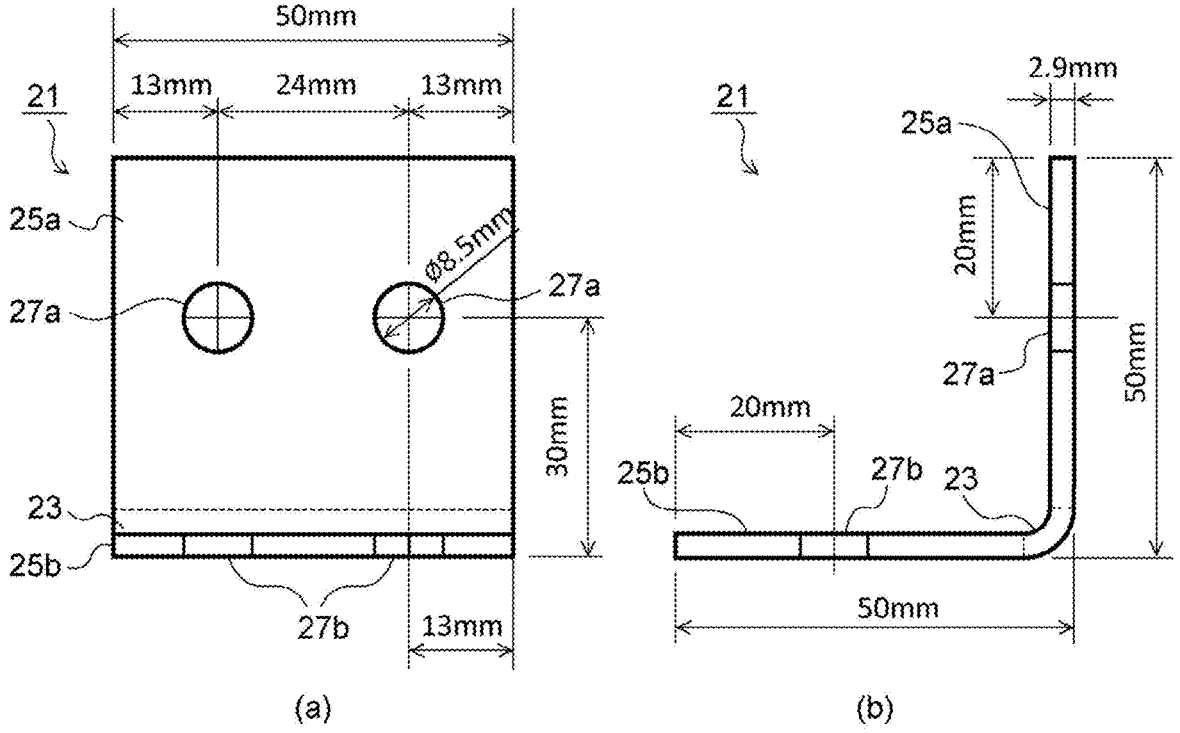
FIG. 5 is a diagram illustrating a fatigue test piece used in a fatigue test in Examples of the present invention (Specifically, (a) is a front view, and (b) is a cross-sectional view).

In the present Example, a fatigue test was performed on a fatigue test piece 21 illustrated in FIG. 5 as a test target, and the fatigue strength was evaluated.

A hot rolled steel sheet having a sheet thickness of 2.9 mm and a yield strength of 850 MPa class was cut out into 200 mm×50 mm as a sample. The sample was bent using a press brake (bending machine) including a bending tool (punch) having a tip radius of curvature 3 mm to prepare a fatigue test piece 21. The fatigue test piece 21 includes: a bent portion 23 of a bend inner side bending radius R=2 mm and a sheet thickness t=2.8 mm; and piece portions 25*a* and 25*b* extending from both end sides of the bent portion 23, in which holes 27*a* and 27*b* each having a diameter φ 8.5 mm were provided in the piece portions 25*a* and 25*b*, respectively.

Next, as illustrated in FIGS. 1(*a*) and 1(*b*), the bent portion 23 of the fatigue test piece 21 was subjected to needle peening treatment to form the indentation bands 29 at predetermined intervals d in the valley line direction on the bend inner side. Here, the radius of curvature r of the tip of the impact pin 11 used for the needle peening was set such that r=0.2 mm, smaller than the radius of curvature R=2 mm in the cross section of the bent portion 23 in the valley line direction.

Figure 6:
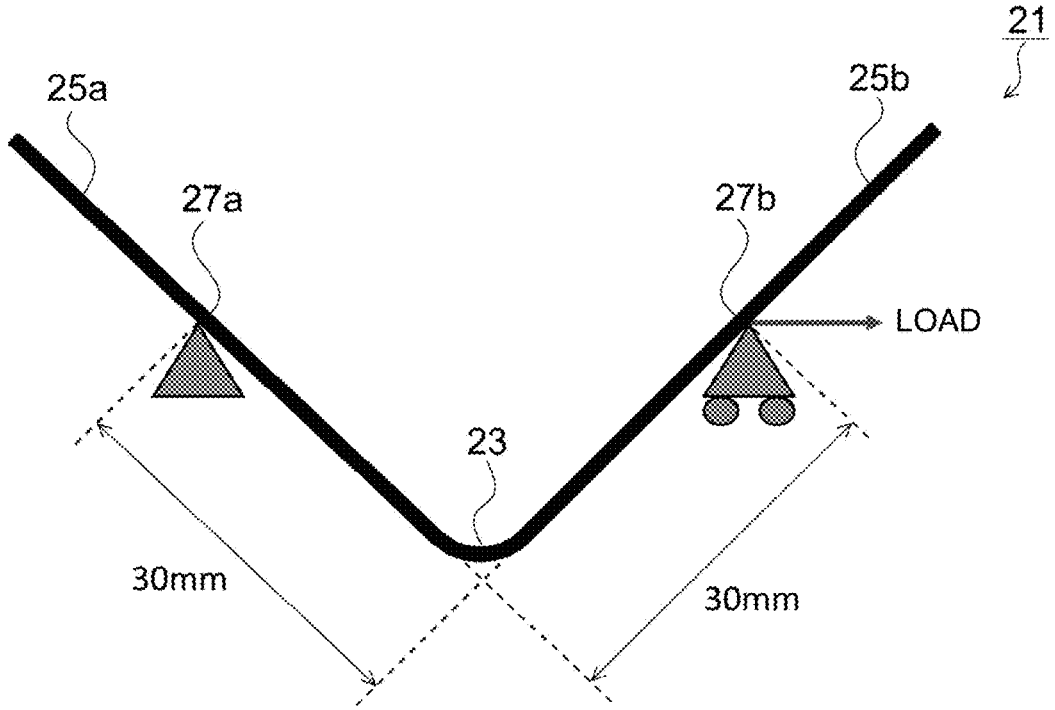
FIG. 6 is a diagram illustrating a fatigue test method in Examples of the present invention.

Subsequently, needle peening treatment was applied on the bent portion 23 of the fatigue test piece 21, and then the fatigue test piece 21 was subjected to a fatigue test under the boundary condition illustrated in FIG. 6. In the fatigue test, as illustrated in FIG. 6, the hole 27*a* of one piece portion 25*a* (FIG. 6) of the fatigue test piece 21 was fixed as a fixing point, while a cyclic load (load 2.3 kN, repetition frequency 10 Hz) was applied on the fatigue test piece 21 with the hole 27*b* of the other piece 25*b* set as a load input point.

Thereafter, a penetrant inspection test of the bent portion 23 was performed every 10,000 load input cycles to measure the growth of a crack generated in the bent portion 23. The fatigue test piece in which the grown crack passed through two or more indentation bands 29 was determined to be unacceptable because of the crack growth, and the fatigue test was terminated. In addition, with the number of cycles of the cyclic load of 500,000 times set as a fatigue limit, the fatigue test piece 21 that reached the fatigue limit was determined to be acceptable, and the fatigue test was terminated.

In the present Example, the fatigue test was performed on the fatigue test piece 21 in which the interval d of the indentation bands 29 was varied, and the fatigue test pieces 21 having intervals d of 3 mm, 4 mm, and 5 mm, which are equal to or larger than the sheet thickness of the metal sheet 1 within the scope of the present invention, were defined as Invention Example 1, Invention Example 2, and Invention Example 3, respectively. For comparison, a test piece having the interval d=2 mm of indentation band 29, which is outside the scope of the present invention, was defined as Comparative Example 1. Table 1 indicates the interval d of the indentation bands 29 formed in the fatigue test piece 21 and the fatigue test results.

TABLE 1

| | Interval d (mm) | Cycles at which fatigue test terminated | Acceptable/ Unacceptable |
|---|---|---|---|
| Comparative Example 1 | 2 | 200,000 | Unacceptable |
| Invention Example 1 | 3 | 500,000 or more | Acceptable |
| Invention Example 2 | 4 | 500,000 or more | Acceptable |
| Invention Example 3 | 5 | 500,000 or more | Acceptable |

In Comparative Example 1, the growth of the crack passed through two or more indentation bands 29 at 200,000 cycles, the test piece was determined to be unacceptable. In contrast, in all of Invention Examples 1 to 3, even at 500,000 cycles, the growth of the crack passing through the two or more indentation bands 29 was not observed before reaching the fatigue limit, and the corresponding test pieces were determined to be acceptable.

As described above, according to the present invention, it has been demonstrated to be able to suppress the growth of fatigue cracks on the bend inner side of the bent portion formed by bending a metal sheet, and able to improve the fatigue life.

INDUSTRIAL APPLICABILITY

The present invention can provide a metal sheet bent portion fatigue crack growth suppressing method, which is capable of suppressing the growth of a fatigue crack of a bent portion, applicable to the bent portion after being bent without increasing the manufacturing cost of the bending of the metal sheet, without deteriorating the productivity and without changing the bending angle of the entire part or the bent portion, and provide an automotive part including a bent portion formed by bending the metal sheet, and capable of suppressing the growth of the fatigue crack in the bent portion.

REFERENCE SIGNS LIST

1 METAL SHEET
3 BENT PORTION
3*a* BENDING START POINT
3*b* BENDING END POINT
5 CRACK
7 INDENTATION
9 INDENTATION BAND
11 IMPACT PIN
13 TIP
21 FATIGUE TEST PIECE
23 BENT PORTION
25*a*, 25*b* PIECE PORTION
27*a*, 27*b* HOLE
29 INDENTATION BAND

The invention claimed is:

1. A metal sheet bent portion fatigue crack growth suppressing method of suppressing a growth of a fatigue crack generated in a bent portion formed by bending a metal sheet, comprising forming a plurality of indentation bands spaced apart from each other at an interval equal to or larger than a sheet thickness of the metal sheet in a valley line direction so as to generate a compressive residual stress, wherein each of the indentation bands extends in a direction orthogonal to the valley line direction from a bending start point to a bending end point on a bend inner side of the bent portion, and wherein each of the indentation bands comprises a series of indentations.

2. The metal sheet bent portion fatigue crack growth suppressing method according to claim 1, wherein the compressive residual stress is generated by forming as the plurality of indentation bands by a needle peening treatment using an impact pin, and the impact pin has a radius of curvature of a tip thereof, in a cross section orthogonal to the valley line direction, equal to or less than a radius of curvature of the bent portion.

3. An automotive part comprising a bent portion formed by bending a metal sheet, wherein a growth of a fatigue crack is suppressed in the bent portion; and a plurality of indentation bands spaced apart from each other along a valley line direction of the bent portion at an interval equal to or larger than a sheet thickness of the metal sheet in the valley line direction, wherein each of the indentation bands extends in a direction orthogonal to the valley line direction from a bending start point to a bending end point on a bend inner side of the bent portion, and wherein each of the indentation bands comprises a series of indentations formed by a needle peening treatment using an impact pin.

* * * * *